US006363566B1

(12) United States Patent
Collins

(10) Patent No.: US 6,363,566 B1
(45) Date of Patent: Apr. 2, 2002

(54) DRAIN VALVE AND PIPE BLOCKAGE CLEARING DEVICE

(76) Inventor: Michael Collins, 1227 Camp Buddy Rd., Ridgeville, SC (US) 29472

( * ) Notice: Subject to any disclaimer, the term of this patent is extended or adjusted under 35 U.S.C. 154(b) by 0 days.

(21) Appl. No.: 09/465,255

(22) Filed: Dec. 18, 1999

(51) Int. Cl.[7] ..... B08B 9/02

(52) U.S. Cl. ..... 15/104.05; 15/104.16; 4/255.01; 137/245.5

(58) Field of Search ..... 15/104.03, 104.05, 15/104.16; 4/255.01, 255.02, 255.04, 255.06; 137/245.5

(56) References Cited

U.S. PATENT DOCUMENTS

| | | | | | |
|---|---|---|---|---|---|
| 232,376 | A | | 9/1880 | Staples | 137/242 |
| 267,306 | A | | 11/1882 | Gall | 137/242 |
| 528,459 | A | | 10/1894 | Beliveau | 137/242 |
| 729,710 | A | | 6/1903 | Weaver | 4/692 |
| 898,234 | A | | 9/1908 | Lisenby | 137/216.1 |
| 903,836 | A | | 11/1908 | Burleigh | 4/679 |
| 986,844 | A | * | 3/1911 | McCloskey | 15/104.05 |
| 1,159,977 | A | * | 11/1915 | Massey et al. | 15/104.05 |
| 1,238,269 | A | | 8/1917 | Cornwell | 134/169 C |
| 1,293,604 | A | * | 2/1919 | Woolever | 15/104.05 X |
| 1,495,303 | A | | 5/1924 | Heidelberg | 137/238 |
| 1,553,034 | A | * | 9/1925 | Donnelly | 15/104.05 |
| 1,903,735 | A | | 4/1933 | Krieger | 4/255.06 |
| 2,020,241 | A | * | 11/1935 | Dimmig | 15/104.05 X |
| 2,576,640 | A | | 11/1951 | Ramsey | 4/255.01 |
| 2,668,551 | A | | 2/1954 | Clement | 134/169 C |
| 3,143,302 | A | * | 8/1964 | Carlson et al. | 15/104.16 X |
| 3,145,733 | A | | 8/1964 | Shaw et al. | 137/583 |
| 3,303,789 | A | | 2/1967 | Geisinger | 415/221 |
| 3,323,546 | A | | 6/1967 | Lord | 137/615 |
| 3,472,427 | A | | 10/1969 | Schaefer | 222/147 |
| 3,872,521 | A | | 3/1975 | Friedman | 4/255.01 |
| 3,922,746 | A | * | 12/1975 | Strunk | 15/104.16 X |
| 4,173,806 | A | | 11/1979 | Hammelmann | 15/104.061 |
| 4,321,096 | A | * | 3/1982 | Dobbin | 15/104.05 X |
| 4,418,888 | A | | 12/1983 | Jacobson et al. | 251/216 |
| 4,589,629 | A | | 5/1986 | Gaffney et al. | 251/288 |
| 4,589,872 | A | | 5/1986 | Bellin et al. | 604/246 |
| 4,783,925 | A | | 11/1988 | Pollock, Jr. | 42/90 |
| 4,893,361 | A | | 1/1990 | Burns | 4/668 |
| 4,898,201 | A | * | 2/1990 | Conley et al. | 137/245.5 |
| 4,919,154 | A | | 4/1990 | Engle | 134/22.12 |
| 5,035,796 | A | * | 7/1991 | Saylor et al. | 15/104.05 X |
| 5,152,843 | A | | 10/1992 | McDonald et al. | 134/22.1 |

* cited by examiner

*Primary Examiner*—Mark Spisich
(74) *Attorney, Agent, or Firm*—Michael E. Mauney

(57) ABSTRACT

A blockage clearing apparatus to clear blockages in both drain valves and in pipes. A cylindrical housing holds a piston connected to a cylindrical rod. The piston moves within the cylindrical housing in response to pressure placed on the piston either manually by an operator or by hydraulic or pneumatic power. As the piston moves in the cylindrical housing, the rod connected to the piston moves back and forth in response to the motion of the piston. The blockage clearing apparatus is mounted to a drain valve or to an opening in a pipe. When operated by pneumatic power, valves, manual or solenoid controlled, will control the flow of air in and out of ports in the cylindrical housing, creating a pressure differential within the housing to actuate the motion of the piston, hence, of the rod. The rod will extend from the housing through an open drain valve and into the pipe that is in fluid communication with the drain valve. The rod will break open any blockages in either the drain valve or in the pipe, which inhibits fluid communication between the interior of the pipe and the drain valve. The blockage clearing apparatus can be placed into a specially created opening in a pipe where it is predictable blockages may occur. The blockage clearing apparatus can be actuated to extend and to retract the cylindrical rod to break loose any blockages occurring at the point the blocking clearing apparatus is mounted in the pipe.

2 Claims, 5 Drawing Sheets

DRAIN VALVE AND PIPE BLOCKAGE CLEARING DEVICE

FIELD OF INVENTION

The present invention relates generally to plumbing devices and more specifically to a device to dislodge flow impediments in a pipe or drain.

BACKGROUND OF INVENTION

Pipes to carry fluids are ubiquitous in homes, business, and in industrial settings. Fluids of all kinds are carried in pipes. These may range from gases to water, which are common in home settings, to pipes that carry highly viscus liquids, such as polymers or heavy crude oils or even molten metals or solid/liquid slurries. A characteristic of a piping system carrying liquid is that force applied to any one point of the pipe is carried by hydraulic forces to any other point within the system. For liquids, this means that water delivery to upper floors of skyscrapers are possible along with any number of other desirable results.

However, one of the problems in any fluid piping system is that the piping system is susceptible to blockage. Foreign objects can enter the system and can become entrapped within the confines of the piping. This inhibits or even may stop the fluid flow through that section of the pipe. Moreover, solids can build up on the interior of the pipe due to impurities within the fluid flow, corrosion of the pipe, or other causes and this can lead to effective reduction of the flow diameter of the interior pipe and inhibit the free flow of liquid through the pipe.

The interior of a piping system has limited access due to its very nature. Any drain or valve opening in the system is potentially a source of leakage from the system. This means that the liquid contained within the system can leak out. This can result in damage caused by the liquid once it escapes the pipe and/or wastage of the liquid within the pipe. Anyone who has ever left a drain open in their home and seen the resulting water bill or had a pipe break due to freezing of water and seen the resulting water damage can appreciate why piping systems are limited access systems. However, this limited access creates problems of its own. Anyone unclogging a sewer drain or bathroom sink drain knows that a blockage at a point inaccessible from the opening can cause major problems. Consequently, a variety of devices have been employed to unclog blockages in plumbing systems or in drain valves.

One type of device that is used to break up a clog is a plumber's snake. This is simply a long flexible tube that is passed down a pipe. The flexible nature of the snake allows it to pass through S-shaped places in the pipe that are used as a drain trap to extend through the pipe to the point where the blockage may occur. There the end of the snake is used to physically break up or otherwise unclog whatever is blocking the pipe. Some of these devices employ a rotating blade to clear out such things as tree roots. One common commercial service that deploys this method is called "Rotor Rooter".

Another way of attacking clogs in drain traps or pipes is to use a chemical agent. Usually some type of caustic agent is employed for this purpose, commonly some kind of lye is used in home applications. Drano® is one type of chemical caustic agent employed.

In industrial settings regular maintenance is required on piping systems. This is especially true where the piping systems are employed to transport chemicals that may be highly viscus or may have a large amount of dissolved chemicals present within the liquid substrate. Oftentimes, the chemicals being transported within the pipes are themselves caustic or may in some other way be harmful to people who could be exposed to the chemicals. To facilitate scheduled maintenance of a piping system, a series of drain valves will be placed throughout the system to open and drain a portion of the system in fluid communication with those drain valves. However, the drain valves themselves are particularly subject to blockage since they are ordinarily substantially smaller in diameter than is the pipe on which the drain valve is fitted. Hence, if between times of cleaning, the drain valve itself becomes clogged, it cannot serve its purpose to allow regularly scheduled maintenance of industrial pipes. Moreover, the entire bottom of a pipe can be clogged with sediment effectively closing off the drain valve. When a blockage occurs, typically, an employee will be required to go to that drain valve and using a rigid rod force an opening through the blockage to allow flow out of the drain valve. However, frequently the employee must dress in protective clothing since the blockage may consist of caustic or otherwise dangerous chemicals. The liquid within the pipe may be under pressure, resulting in a sudden outflow of caustic or otherwise dangerous chemicals potentially injuring the worker. Additionally, the liquids and chemicals may be at a higher temperature than is safe. All of these factors may result in considerable risk to the worker who is required to open a clogged drain valve.

A number of patents have been developed for dealing with blockages within a system. One common method employed is to use a mechanical force transmitted by hydraulic pressure from a remote point to the point of the blockage. Perhaps the simplest and most commonplace example of this type of system is the plunger or plumber's helper used in home settings. An example of a patented apparatus employing hydraulic pressure is seen in Engle U.S. Pat. No. 4,919,154. There a purging assembly is connected to the blocked pipe system by a connector. A sub-assembly produces repeated hydraulic shocks through the fluid in to the blocked pipe system. This device is particularly well adopted for use in extensive piping systems found in large building complexes. Burns U.S. Pat. No. 4,893,361 uses a different technology. Here transducers are connected to a drain trap to produce ultrasonic signals to create vibrations within the drain trap. It is believed that these vibrations are effective in clearing the clogging material. A moveable mechanical device is disclosed in Hammelman U.S. Pat. No. 4,173,806. There an apparatus with an adjustable washer slidably engages the internal surface of a pipe. Pressure from a fluid propels the housing forward until the housing encounters an obstruction. Cutting tools are fitted into the housing for clearing the obstruction. Ramsey U.S. Pat. No. 2,576,640 discloses a combined clean out and flow control device for fluid lines. This involves a mechanical plunger. It is designed particularly for use in a pipe where there is a reduced aperture for controlling the flow of fluid. In Ramsey a generally cylindrical shaped body is threaded into an inlet to the pipe. There is a plunger threaded onto the cylindrical body to clean an obstruction. The plunger is pushed inward into the draining system. Beliveau U.S. Pat. No. 528,459 shows a permanently fitted plunger to a drain trap and a rubber disc is fitted inside the pipe approximately the diameter of the pipe with a T-shaped plunger connected to the rubber disc and outside of the pipe. When the drain trap clogs, one simply pushes the plunger down to clear the pipe by hydraulic and mechanical pressure. Gall U.S. Pat. No. 267,308 shows a mechanical scraper device permanently fitted in a drain trap. It can be withdrawn and extended through a portion of the drain trap to mechanically clear an obstruction caught within the drain trap. However, despite all of this prior art there is still room, especially in industrial applications, for a new way of cleaning obstruction in pipes.

SUMMARY OF INVENTION

Accordingly it is an object of the current invention to provide a mechanical means for clearing a blockage in a piping system at a drain valve or at other locations where blockages occur frequently. It is an object of the current invention to provide for greater worker safety in an industrial environment when dealing with blockages in piping systems for caustic chemicals or fluids at high or low temperature. It is an object of the current invention to provide for remote operation of the blockage clearing apparatus. It is an object of the current invention to provide an apparatus that may easily be adopted to different modes of powering the mechanical means for clearing the blockage.

A preferred embodiment of the present invention is a plunger device fitted to a threaded coupling device for connection to a pipe. It will be placed at a position or point in a pipe where a blockage may be expected. For example, six-inch steam pipes are common in industrial applications. Often there will be dissolved minerals in the steam. Over a period of time the minerals dissolved in the steam will precipitate on the pipe, building up within the pipe to reduce the diameter of the pipe. These steam pipes will frequently be fitted with drain valves used as part of the regular maintenance of the steam pipes. Thus, during a maintenance period, the steam will be purged from the pipe and a chemical solvent may be used to clean the interior of the pipe. The solvent must be drained from the pipe by the drain valves that have been placed in the pipe for that purpose. However, frequently these drain valves will become clogged or the pipe itself may be completely coated in sediment at the location of the drain valve. In either case the drain valve must be broken open. Currently, if a drain valve is clogged, a worker will be dressed in a protective suit, be provided with a rod of appropriate diameter, and will be sent to a clogged drain valve with instructions to use the rod to break open the mechanical obstruction. This operation may be required when the pipe is filled with the chemical solvent or when the pipe is filled with steam. When the obstruction is cleared, there will be a flow of whatever is in the pipe out the drain valve, be it solvent or steam. This can pose a danger to the worker. Consequently, it would be an advance in the art to provide a drain valve mounted, mechanically actuated rod system, which could be used to clear any block of a drain valve. This would eliminate the need for a worker dressed in a protective suit to manually clear the blockage. The invention can be permanently mounted on each drain valve, since it is relatively simple to build and inexpensive to use. It could be provided with a pneumatic power source, since most plants have air pressure lines readily available. Hydraulic power could be employed as well to accentuate the piston that is used to physically clear the blockage or an operator could use a hammer to hit one end of the rod to force open the blockage in a drain valve.

Although the current invention will find its widest application in already pre-fitted drain valves for piping systems, it may also be used in other piping applications. For example, various types of plastics or polymers are heated to the melting point and transported through pipes as a heated liquid. However, where these pipes have a sharp turns, "cold" spots can develop. The molten plastics solidify if the temperature at these spots drops below the melting point of the material being transported through the pipes. Thus, a blockage can develop at these "cold" spots. The current invention could be fitted into an opening and aligned in a way that would enable the current invention to operate periodically or as required to break any solidified plastics or other materials away from the walls of the transport pipe at these "cold" spots.

It is another advantage of the current invention that it may be made as a simple compact, potentially portable apparatus for use in applications that use pre-existing drain fittings. It is of further advantage the present invention operates by mechanical force and does not create stress on the pipe system itself by introducing or requiring high hydraulic pressures within the pipe system. The present invention reduces or eliminates the need for an introduction of chemical agents into the fluid to dissolve or otherwise remove blockages around a drain valve.

These and other objects and advantages of the present invention will become clear to those skilled in the art upon a review of the following specification and claims.

DETAILED DESCRIPTION OF THE DRAWINGS

Figure 1:
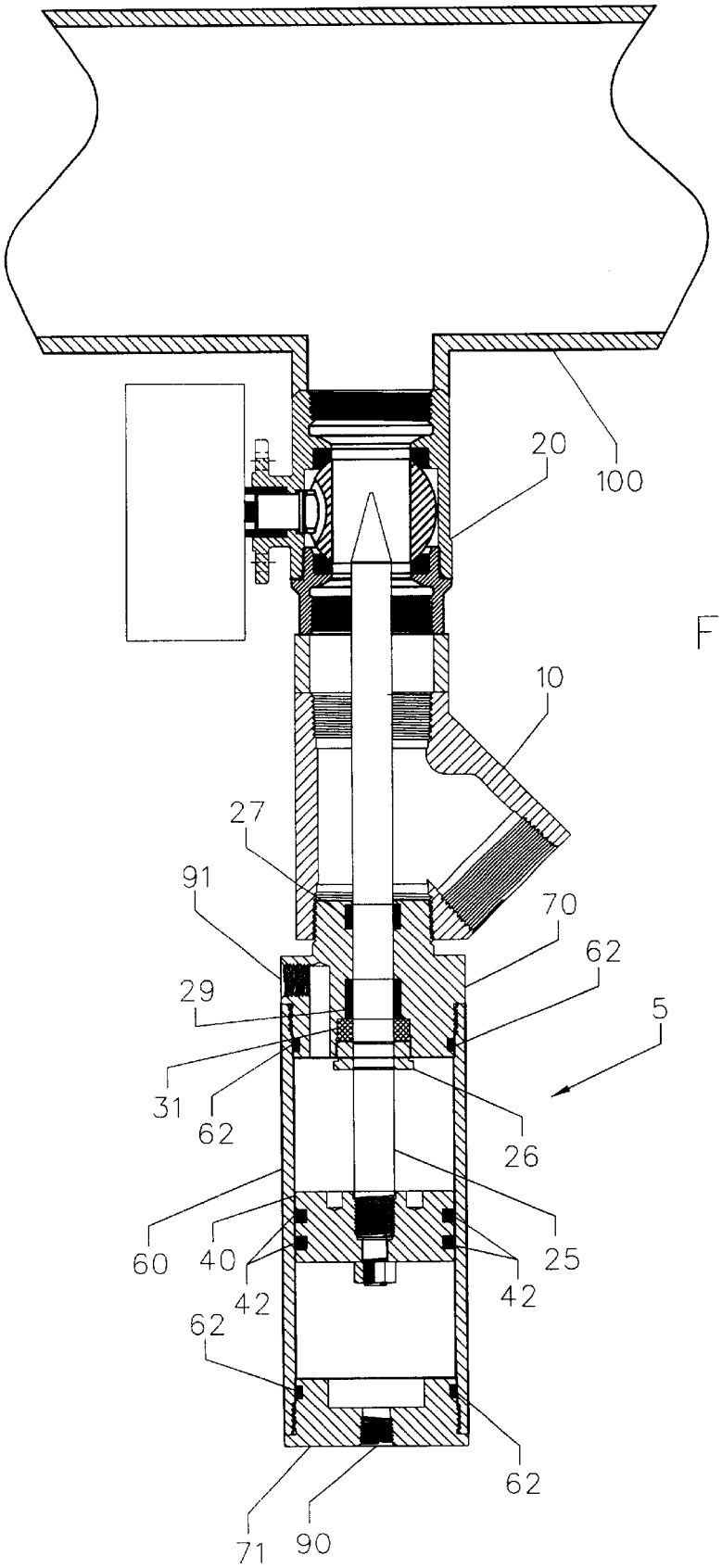
FIG. 1 shows in cut-a-way a portion of current invention fitted to a drain valve.

The blockage clearing apparatus (5) is shown in FIG. 1. There is a cylinder rod (25) mounted for slidable movement. Disposed at one end of the cylinder rod (25) is a piston (40). This piston (40) is mounted for slidable movement in a cylinder housing (60). The piston (40) will have O-rings (42) to maintain a seal between the two portions of the cylinder housing (60) separated by the piston (40). A pneumatic power source will be connected to an inlet port (90) in the port end cap (71) in order to provide air or hydraulic pressure for slidable movement of the piston (40) within the cylinder housing (60) which also necessarily results in slidable movement of the cylinder rod (25). The movement of the cylinder rod is in response to pressure from hydraulic fluid or of air. At the opposite end of the cylinder housing (60) from the inlet port (90), is an outlet port (91) to bleed off air or hydraulic fluid from the cylinder housing (60) to control movement of the piston (40) and the cylinder rod (25). The cylinder rod (25) is mounted on a gland screw (26). The gland screw (26) is for packing adjustment and to assure no leakage of pipe fluids into the cylinder housing (60). The cylinder rod (25) is also mounted using a low friction, low reactive plastic packing set (31) of the type known by the trade name of Teflon® and a synthetic bearing (29). The cylinder housing (60) is secured in a Y-drain fitting (10) by means of a drain end cap (70). The port end cap (71) and the drain end cap (70) are mounted in rings (62) for a tight seal. The cylinder rod (25) passes through a low friction, low reactive wiper ring (27) before entering the Y-drain fitting (10). Shown disposed in the Y-drain fitting (10) is a ball drain valve (20) which is used to drain the pipe (100).

If it is desired to drain the pipe (100), the ball drain valve (20) will be placed in an open position (shown in FIG. 1) aligning its bore with the cylinder rod (25). If there is no blockage, the liquid disposed within the pipe (100) will drain through the ball valve (20) and out the opening of the Y-drain (10). However, should there be a blockage preventing flow through the ball drain valve (20), it will be necessary to activate the blockage clearing apparatus (5). A pneumatic or hydraulic power source will be activated creating a pressure differential in the cylinder housing (60) so that the portion of the cylinder housing (60) that is proximal to the ball drain valve (20) has a lower pressure than the portion distal to the ball drain valve (20). Increased pressure will force the piston (40) toward the ball drain valve (20) and necessarily force the cylinder rod (25) forward through the opening in the ball drain valve (20) breaking any blockages free. This will allow any accumulated pipe liquids within the pipe (100) to begin to drain through the ball drain valve (20) and out of the Y-drain (10). Then, the pressure differential will be reversed, causing the cylinder rod (25) to reverse its motion and forcing the piston (40) away from the end of the cylinder housing (60) that is proximal to the ball drain valve (20) and toward the portion of the cylinder housing (60) that is distal to the ball drain valve (20). The wiper ring (27) will serve to remove any chemicals, liquids, or the like that are clinging to the cylinder rod (25). Once the cylinder rod (25) is fully withdrawn, the ball drain valve (20) and the Y-drain (10) will operate normally. The cylinder rod (25) needs to be made of a non-reactive rigid material. Stainless steel would be the material of choice under ordinary circumstances. The cylinder housing (60) will ordinarily be made of aluminum. The drain end cap (70) that is fitted to the Y-drain (10) is ordinarily made of stainless steel. The port end cap (71) may be made of stainless steel or aluminum.

Figure 2:
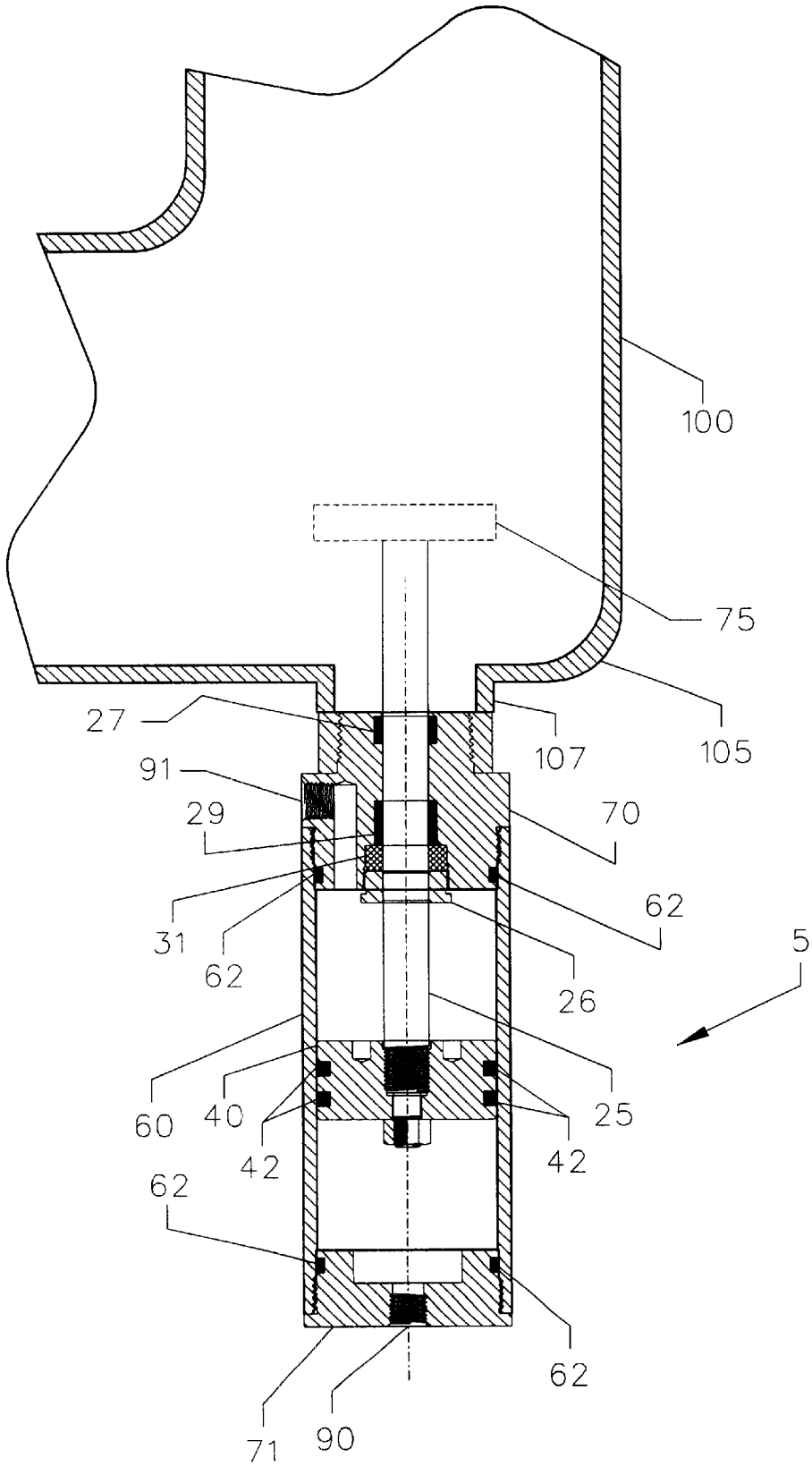
FIG. 2 shows in cut-a-way a potion of current invention fitted to an elbow bend in a pipe.

FIG. 2 shows the blockage clearing apparatus (5) fitted to an elbow bend (105) of a pipe (100) in an opening (107) created for placement of the blockage clearing apparatus (5). As before, there is a cylinder rod (25) mounted to a piston (40) for slidable movement inside a cylinder housing (60). There is an inlet port (90) piercing the port end cap (71) and an outlet port (91) on the opposite end of the cylinder housing (60) from the inlet port (90). The drain end cap (70) has a bore for passage of the cylinder rod (25) and is filled with a wiper ring (27). A piston (40) is slidably mounted for movement on O-rings (42). The port end cap (71) and the drain end cap (70) are mounted in rings (62) for a tight seal. There is a gland screw (26) through which the cylinder rod (25) passes. The cylinder rod (25) also passes through a packing set (31) and a synthetic bearing (29).

At elbow bends (105) in pipes (100) molten material may solidify because of turbulence in the flow, loss of temperature, or similar phenomenon. Consequently, it is predictable that blockages may develop at this point in the pipe. Therefore, the blockage clearing apparatus (5) may be permanently or temporarily mounted at this point for operation of the cylinder rod (25) to produce a mechanical force within the pipe to dislodge any solid material. In some circumstances an end fitting (75), shown in dotted lines, will be affixed to the end of the cylinder rod (25) to increase the effective striking area of the cylinder rod (25) and more effectively clear blockages within the elbow bend (105). Again there is an inlet port (90) and an outlet port (91) which may be used to apply pneumatic or hydraulic force to the piston (40) for slidable movement within the cylinder housing (60), hence, slidably moving the cylinder rod (25) and the end fitting (75).

Figure 3A:
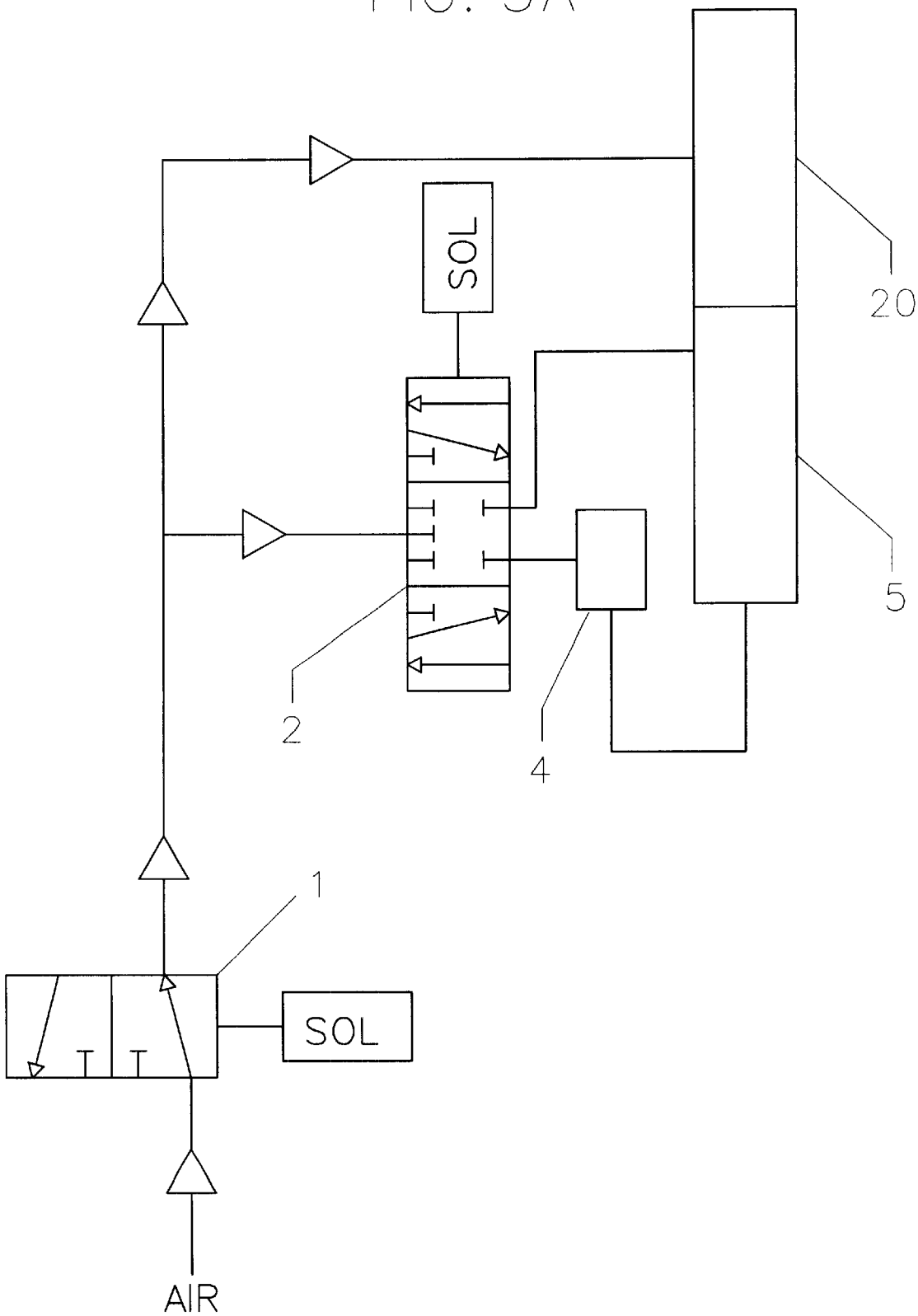
FIG. 3A shows in schematic form the remote operation embodiment of the current invention using pneumatic power.

FIG. 3A is a schematic showing the operation of the valves which control operation of the blockage clearing apparatus (5) and the ball valve (20) using pneumatic power. When pneumatic power is used, air is fed into intake valve (1). Intake valve (1) is a three-way pneumatic valve with an open exhaust. It is controlled by a solenoid, shown by the abbreviation "sol" in FIG. 3A, or could be manually controlled. The intake valve (1) serves to control air flow in a line and to vent downstream pressure when the valve is closed. A type of commercially available control valve which serves this purpose is the RexRoth Mini-Master Three-Way, Two-Position, Single Solenoid Valve. (Assigned RexRoth Part No. GC13101-2455). If this intake valve (1) is in an open position, air will flow downstream from intake valve (1) to a branch to flow onward to other valves. The air will flow to the ball valve (20). The ball valve (20) is equipped with an internal spring actuator (3) (shown in FIG. 3B) which maintains pressure to bias the ball valve (20) in the closed position. When pressured air flows to the ball valve (20), it overpowers the spring actuator (3) and moves the ball valve (20) into the open position. When there is no pressured air flowing to the ball valve (20), the spring actuator (3) returns the ball valve (20) to a closed position. A type of commercial spring actuated, ball valve that is available in the marketplace is the Conbraco 76-AR Series. Consequently, whenever there is air in the system to operate the blockage clearing apparatus (5), the ball valve (20) will be open and if there is no air in the system, the ball valve (20) will be closed. This is a safety device to make sure that the blockage clearing apparatus (5) never operates with the ball valve (20) in a closed position, which would both damage the ball valve (20) and the blockage clearing apparatus (5). When intake valve (1) is in an open position, air pressure also flows to a control valve (2). The control valve (2) is a four-way pneumatic valve with open exhaust. One type of commercially available four-way valve is the RexRoth four-way/three-position double solenoid valve (RexRoth part #PS32020-1515). The control valve (2) serves to control air flow from a common supply into one or the other of two lines, allowing air to flow into one line while venting the other line. These valves are commonly used in double acting cylinders like that that is part of the blockage clearing device (5). Placed at the inlet port (90) (not shown) of the blockage clearing device (5) is a flow regulating valve (4). This flow regulating valve (4) is a flow control valve which allows full flow in one direction while restricting flow in the other. Full flow would be allowed into the inlet port (90) (not shown) to fully power the piston (40) (not shown). Hence, full flow of the air would flow into the portion of the cylinder housing (60) (not shown) that is distal to the ball valve (20) resulting in a most forceful forward movement of the cylinder rod (25) (not shown). Flow out of the cylinder housing (60) (not shown) would be restricted so that the cylinder rod (25) (not shown) would be withdrawn at a slower rate. This allows better cleaning of the cylinder rod (25) (not shown) and less chance for backflow of liquids into the cylinder housing (60). This type of flow regulating valve is commercially available. One particular brand is the RexRoth Floreg® flow control valve. (Assigned RexRoth No. P53025-2). Instead of solenoid (sol) remote operation shown in FIG. 3A, each valve in the system may be manually operated.

Figure 3B:
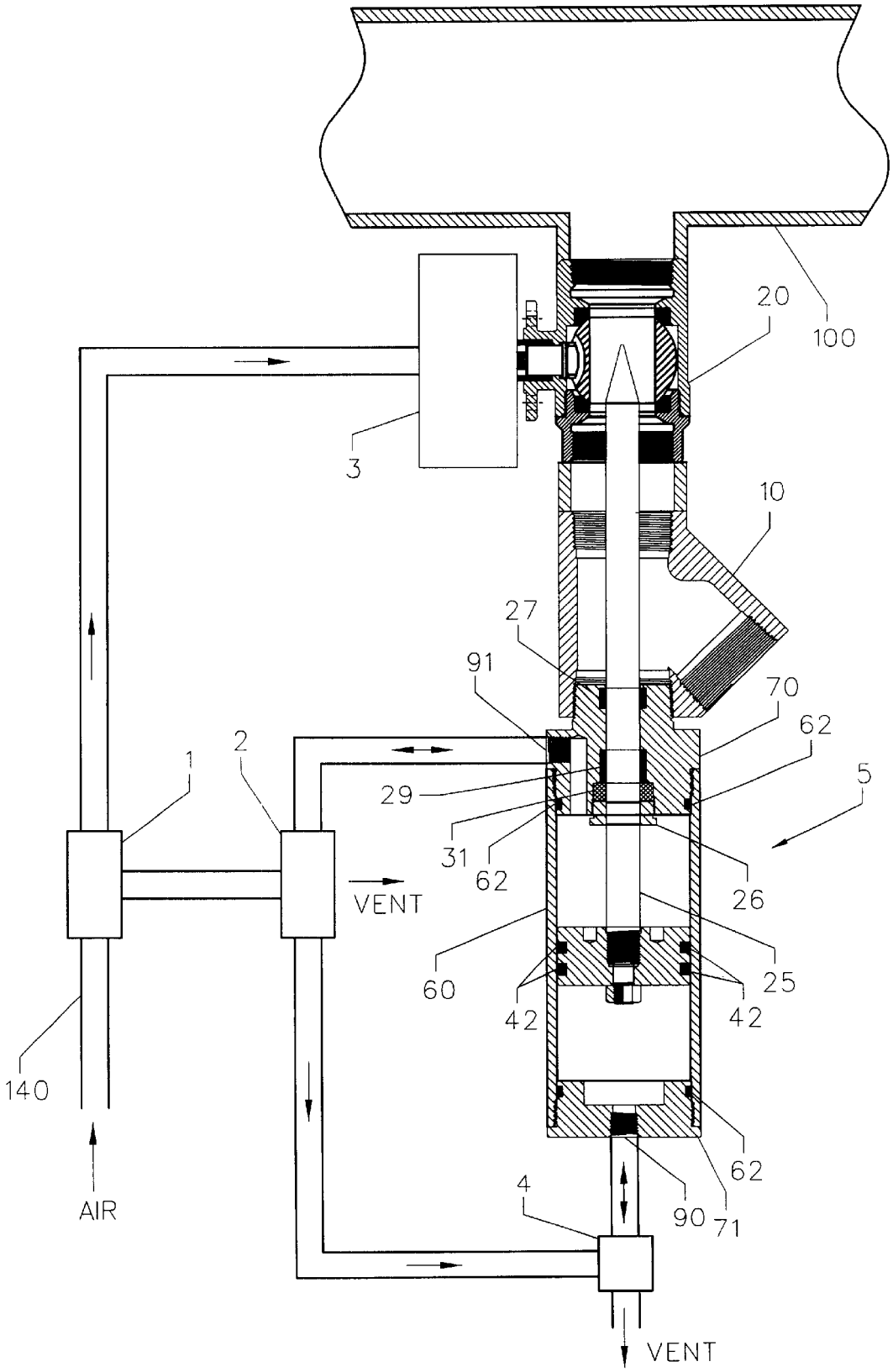
FIG. 3B shows the remote operation embodiment of the current invention using pneumatic power, a portion of the device shown in cut-a-way.

FIG. 3B shows the blockage clearing apparatus (5) as it may be controlled remotely using pneumatic power. The blockage clearing apparatus (5) is shown in cut-a-way but the pneumatic air lines and valves are shown in regular view. A flow regulator valve (4) will be mounted at the inlet port (90). The outlet port (91) for the blockage clearing apparatus (5) is distal to the inlet port (90). Incoming air will come down a pneumatic line (140) to an intake valve (1). Ordinarily, this will be solenoid operated. The intake valve (1) has a dual function of controlling the spring actuator (3) and routing air to a second directional control valve (2). The intake valve (1) operates to insure spring actuator (3) always opens the ball valve (20) when air is routed to the directional control valve (2). The directional control valve (2) will control the extension and retraction of the piston (40) by routing air respectively to the flow regulator valve (4) at inlet port (90) or to the outlet port (91). Thus, all parts of the blockage clearing apparatus (5) and ball valve (20) are operated off one incoming air line. A flow regulator valve (4) is mounted at the inlet port (90) to allow control of the retraction speed of the piston (40) and hence, the cylindrical rod (25). The flow regulator valve (4) will allow full air flow for air entering the cylinder housing at the inlet port (90). This will allow full pressure of the pneumatic air line to force the piston (40) hence, the cylindrical rod (25) forward with the most rapid and forceful motion. When air is flowing out of the inlet port (90), the flow regulator valve (4) restricts the flow to the extent deemed necessary by the operator of the system. The restricted flow will serve as a cushion against the piston retracting too quickly in response to air flow into the outlet port (91). This decreases the retraction speed of the cylindrical rod (25) and helps prevent any flow of liquid or other fluid medium from being drawn back into the cylinder housing(60).

It is possible to control the operation of the blockage clearing apparatus (5) with manually operated valves. This would require an operator be at or near the blockage clearing apparatus (5) when in use.

Figure 4:
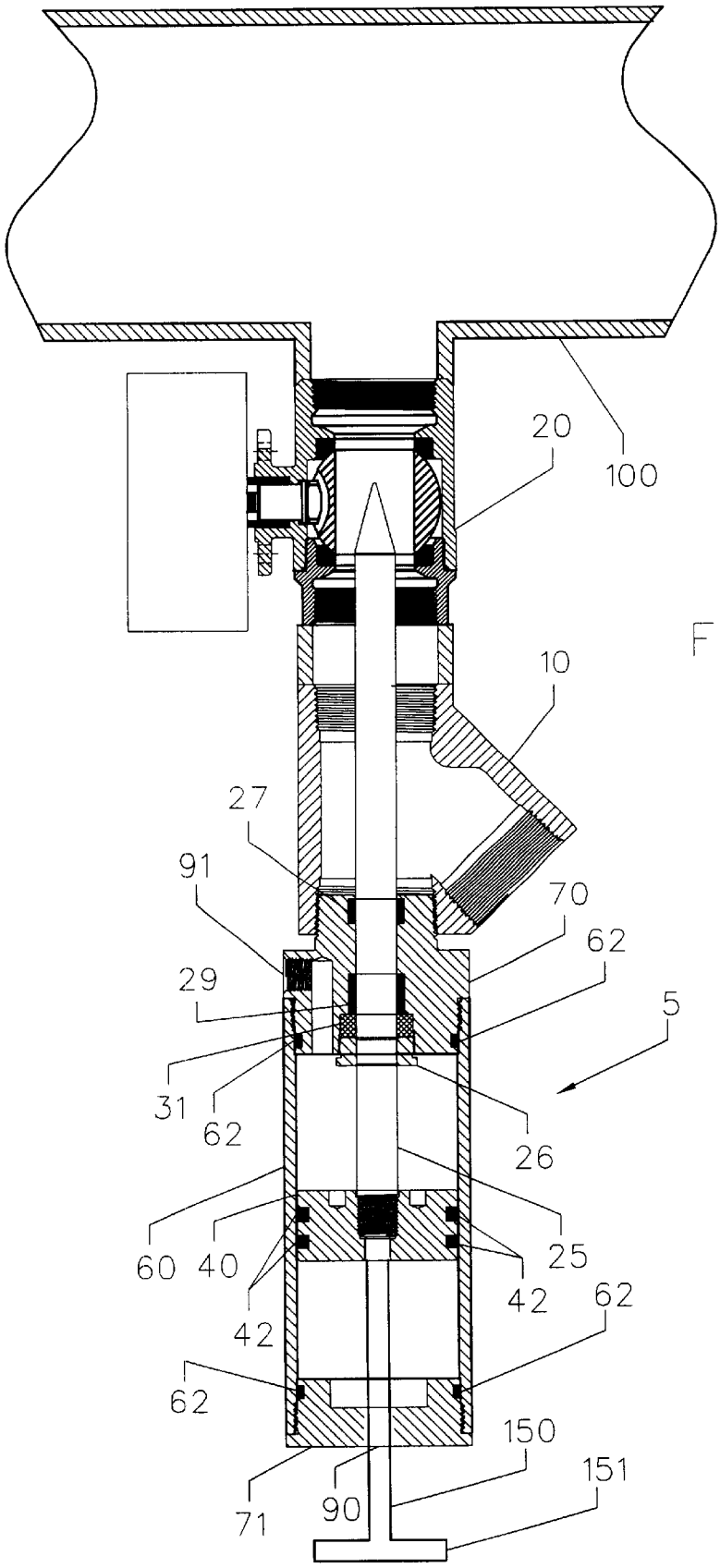
FIG. 4 shows in cut-a-way the current invention using a manually actuated handle.

FIG. 4 shows the blockage clearing apparatus (5) in a manually powered alternative version. Instead of the inlet port (90) serving as an inlet for pneumatic or hydraulic forces, it simply serves as an opening for a cylindrical handle rod (150) which passes through the inlet port (90) and connects directly to the piston (40). The cylindrical rod (25) moves at the rate and with the force applied by the operator who will be holding the T-shaped handle (151) of the cylindrical handle rod (150). The outlet port (91) allows air to leave and enter the cylinder housing (60) as is required by the movement of the piston (40). It is anticipated that the manually powered embodiment of this invention is the one that is more likely to be moved from one Y-fitting (10) to another. This would be a simple matter of unscrewing the blockage clearing apparatus (5) from the Y-fitting (10) and moving it to another Y-fitting at a different point in the pipe. The pneumatically powered and remotely operated embodiment shown in FIG. 3B could be moved, but it would be much more difficult because of the various pneumatic connections, pipes, and the like that are involved in the operation of that embodiment of this invention. The embodiment shown in FIG. 4, which is manually powered, is more likely to find its uses where pipes are less likely to contain hazardous or dangerous materials or where blockages are rare or where pneumatic or hydraulic powered fittings are not readily available or where economy is a prime consideration.

What is claimed is:

1. An apparatus for clearing blockages in a drain valve draining a fluid carrying pipe comprising:

(a) an enclosed housing;

(b) a slidably moveable piston sized to fit within said housing;

(c) a rod of a given length and diameter attached to said slidably moveable piston, at least a portion of said rod extending through a first port in said housing so that as said slidably moveable piston moves within said housing said portion of said rod extending through a first port moves outside of said housing;

(d) pressurized pneumatic means for powering movement of said slidably moveable piston and said rod;

(e) said enclosed housing has a first fluid port distal from said first port and has a second fluid port proximal to said first port, and two solenoid actuated valves whereby an operator may remotely actuate said solenoid actuated valves to control fluid flow of pressurized gas into and out of said first fluid port and into and out of said second fluid port thereby controlling motion of said slidably moveable piston;

(f) means for connecting said housing to a drain valve draining a fluid carrying pipe so that said portion of said rod is of a diameter to extend through said drain valve when said drain valve is in an open position and said portion of said rod is of a length to extend into a pipe being drained by said drain valve;

(g) a third solenoid actuated valve to control pressurized gas flow to said drain valve so that when said slidably moveable piston is operating, said drain valve is always in an open position whereby damage is prevented to the apparatus for cleaning blockages and to the drain valve;

whereby said means for powering causes motion of said slidably moveable piston in said housing so that said rod moves in concert with motion of said slidably moveable piston and said portion of said rod extending through said first port may pass through said drain valve when said drain valve is open into said pipe and mechanically dislodge a blockage of fluid communication of said drain valve and said pipe at where said housing is connected to said drain valve by said means for connecting.

2. An apparatus for clearing blockages in a drain valve draining a fluid carrying pipe comprising:

(a) an enclosed housing;

(b) a slidably moveable piston sized to fit within said housing;

(c) a rod of a given length and diameter attached to said slidably moveable piston, at least a portion of said rod extending through a first port in said housing so that as said slidably moveable piston moves within said housing said portion of said rod extending through a first port moves outside of said housing;

(d) pressurized hydraulic means for powering movement of said slidably moveable piston and said rod;

(e) said enclosed housing has a first fluid port distal from said first port and has a second fluid port proximal to said first port, and two solenoid actuated valves whereby an operator may remotely actuate said solenoid actuated valves to control fluid flow of pressurized liquid into and out of said first fluid port and into and out of said second fluid port thereby controlling motion of said slidably moveable piston;

(f) means for connecting said housing to a drain valve draining a fluid carrying pipe so that said portion of said rod is of a diameter to extend through said drain valve when said drain valve is in an open position and said portion of said rod is of a length to extend into a pipe being drained by said drain valve;

(g) a third solenoid actuated valve to control pressurized liquid flow to said drain valve so that when said slidably moveable piston is operating, said drain valve is always in an open position whereby damage is prevented to the apparatus for cleaning blockages and to the drain valve;

whereby said means for powering causes motion of said slidably moveable piston in said housing so that said rod moves in concert with motion of said slidably moveable piston and said portion of said rod extending through said first port may pass through said drain valve when said drain valve is open into said pipe and mechanically dislodge a blockage of fluid communication of said drain valve and said pipe at where said housing is connected to said drain valve by said means for connecting.

* * * * *